US006008762A

United States Patent [19]

Nghiem

[11] Patent Number: 6,008,762

[45] Date of Patent: Dec. 28, 1999

[54] FOLDED QUARTER-WAVE PATCH ANTENNA

[75] Inventor: David Nghiem, Houston, Tex.

[73] Assignee: QUALCOMM Incorporated, San Diego, Calif.

[21] Appl. No.: 08/825,544

[22] Filed: Mar. 31, 1997

[51] Int. Cl.[6] ..... H01Q 3/02; H01Q 1/24

[52] U.S. Cl. ..... 343/700 MS; 343/702

[58] Field of Search ..... 343/700 MS, 702

[56] References Cited

U.S. PATENT DOCUMENTS

| | | | |
|---|---|---|---|
| 5,365,246 | 11/1994 | Rasinger et al. | 343/702 |
| 5,644,319 | 7/1997 | Chen et al. | 343/702 |
| 5,861,854 | 1/1999 | Kawahata | 343/702 |

FOREIGN PATENT DOCUMENTS

| | | | |
|---|---|---|---|
| 0177362 | 4/1986 | European Pat. Off. | H01Q 1/24 |
| 0332139 | 9/1989 | European Pat. Off. | H01Q 1/32 |
| 0777295 | 6/1997 | European Pat. Off. | H01Q 9/04 |
| 9101577 | 2/1991 | WIPO | H01Q 1/38 |

*Primary Examiner*—Don Wong
*Assistant Examiner*—Jennifer H. Malos
*Attorney, Agent, or Firm*—Russell B. Miller; Thomas M. Thibault; Gregory D. Ogrod

[57] ABSTRACT

A folded quarter-wave patch antenna which includes a conductor plate having first and second arms spaced apart. A ground plane is separated from the conductor plate by a dielectric substrate and is approximately parallel to the conductor plate. The ground plane is electrically connected to the first arm at one end. A signal unit is electrically coupled to the first arm. The signal unit transmits and/or receives signals having a selected frequency band. The folded quarter-wave patch antenna can also act as a dual frequency band antenna. In dual frequency band operation, the signal unit provides the antenna with a first signal of a first frequency band and a second signal of a second frequency band.

8 Claims, 6 Drawing Sheets

FOLDED QUARTER-WAVE PATCH ANTENNA

CROSS-REFERENCE TO RELATED APPLICATIONS

This application is related to commonly-owned applications, filed concurrently herewith, entitled "Dual-Frequency-Band Patch Antenna With Alternating Active And Passive Elements" having application Ser. No. 08/825,542 (abandoned), and "Increased Bandwidth Patch Antenna" having application Ser. No. 08/825,543, which are incorporated herein by reference.

BACKGROUND OF THE INVENTION

I. Field of the Invention

The present invention relates generally to antennas and, more specifically, to a folded quarter-wave patch antenna.

II. Description of the Related Art

Antennas are an important component of wireless communication system. Although antennas may seem to be available in numerous different shapes and sizes, they all operate according to the same basic principles of electromagnetics. An antenna is a structure associated with a region of transition between a guided wave and a free-space wave, or vice versa. As a general principle, a guided wave traveling along a transmission line which opens out will radiate as a free-space wave, also known as an electromagnetic wave.

In recent years, with the increase in use of personal communication devices, such as cellular hand-held and mobile phones and PCS phones, the need for small antennas that are suitable for use in personal communication devices has increased. Recent developments in integrated circuits and battery technology have enabled the size and weight of the communication devices to be reduced drastically over the past several years. One area in which reduction in size is still desired is the communication device's antenna. This is due to the fact that the size of the antenna play an important role in decreasing the size of the device. In addition, the antenna size and shape impact the device aesthetics and manufacturing costs.

An important factor to be considered in designing antennas for personal communication devices is the radiation pattern. In a typical application, the communication device must be able to communicate with another user or a base station or hub which can be located in any number of directions from the user. Consequently, in personal communication devices, it is essential that the antenna has an omnidirectional radiation pattern.

One antenna commonly used in personal communication devices is the whip antenna. There are, however, several disadvantages associated with the whip antenna. Often, the whip antenna is subject to damage by catching on things. Even when the whip antenna is designed to be retractable in order to prevent such damage, it consumes scarce interior space. This results in less interior space being available for advanced features and circuits. Also, as personal communication devices such as cellular phones become smaller, the ability to use the whip antenna efficiently is being challenged.

Another antenna which may also be suitable for use in personal communication devices is the patch or microstrip antenna. The patch antenna was originally developed in the late 1960's for use with aircraft, missiles and other military applications requiring a paper thin or low-profile antenna. These applications required that the antenna neither disturb the aerodynamic flow nor protrude inwardly to disrupt the mechanical structure. The patch antenna satisfied these requirements.

As its name suggests, the patch antenna includes a patch or a conductor plate. The length of the patch is set in relation to the wavelength $\lambda_0$ associated with the resonant frequency $f_0$. When the length of the patch is set at $\lambda/_4$, the antenna is known as a quarter-wave patch antenna.

Unfortunately, currently available patch antennas are generally too large for use in personal communication devices. A reduction in the length of the patch antenna would make it increasingly desirable for use in personal communication devices. For example, a reduction in the length of the patch antenna would make the personal communication device more compact and aesthetic.

SUMMARY OF THE INVENTION

The present invention is directed to a folded quarter-wave patch antenna. According to the present invention, the folded quarter-wave patch antenna includes a folded conductor plate having first and second arms. The folded conductor plate can have a U-shape, V-shape, or other shapes and forms that can be constructed by folding the patch antenna.

The length l of the conductor plate is set in relation to the wavelength $\lambda_0$ associated with the resonant frequency $f_0$. The length l is approximately $\lambda_0/4$. The length of the first arm is approximately $\lambda_0/8$ and the length of the second arm is also approximately $\lambda_0/8$. The first and second arms are spaced apart by a predetermined distance. A ground plane which is approximately parallel to the conductor plate is separated from the conductor plate by a dielectric substrate. A signal unit may be coupled to the first arm. The signal unit provides a signal of a selected frequency band to the first arm.

Further features and advantages of the invention, as well as the structure and operation of various embodiments of the invention, are described in detail below with reference to the accompanying drawings.

BRIEF DESCRIPTION OF THE DRAWINGS

In the drawings, like reference numbers generally indicate identical, functionally similar, and/or structurally similar elements. The drawing in which an element first appears is indicated by the leftmost digit(s) in the reference number. The present invention will be described with reference to the accompanying drawings, wherein.

DETAILED DESCRIPTION OF THE PREFERRED EMBODIMENTS

Figure 1:
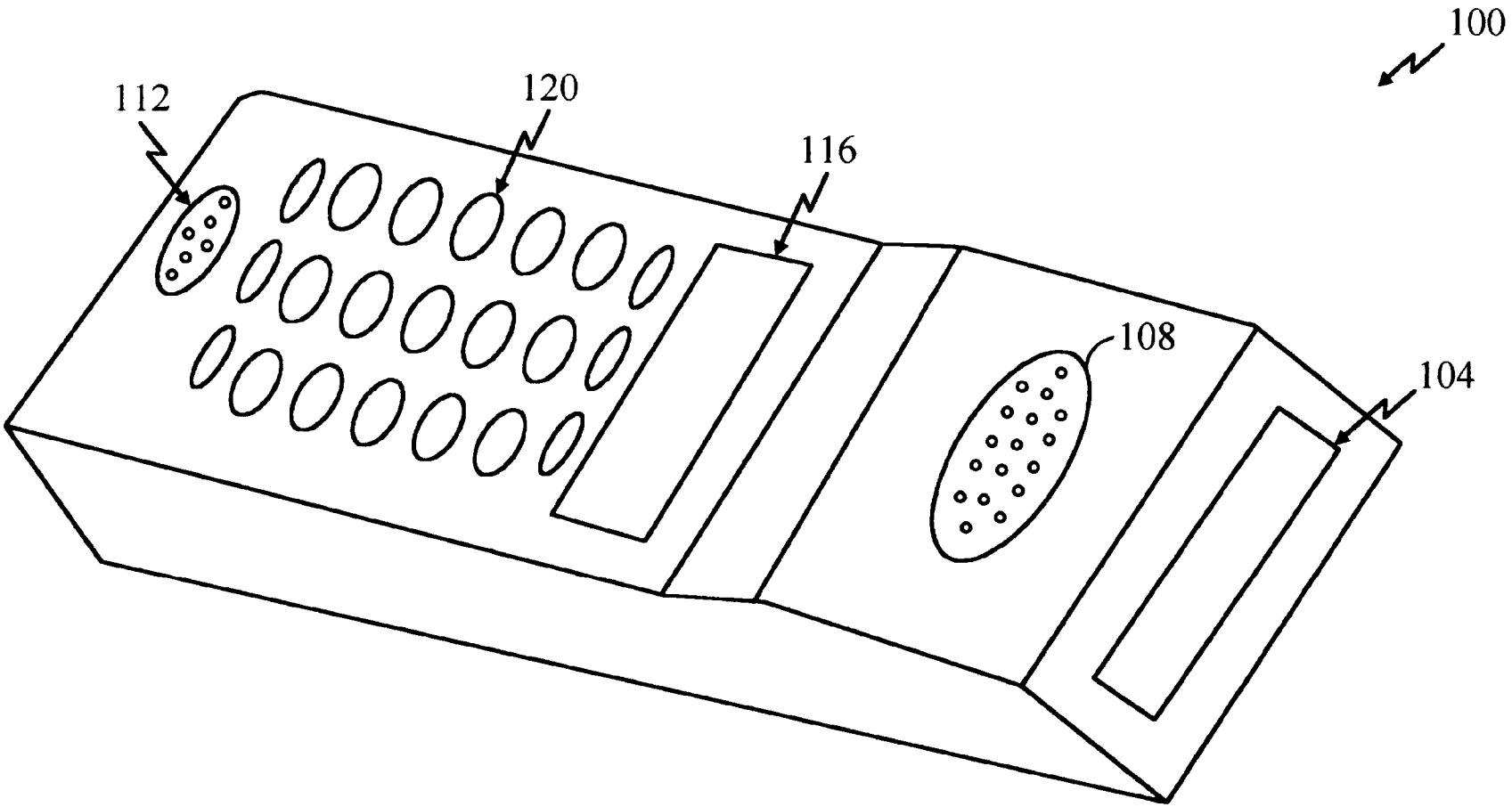
FIG. 1 illustrates a portable telephone utilizing the present invention.

1. Overview and Discussion of the Invention

As discussed earlier, the patch antenna was originally developed in the late 1960's for use with aircraft, missiles and other military applications requiring a thin or low-profile antenna. These applications required that the antenna neither disturb the aerodynamic flow nor protrude inwardly to disrupt the mechanical structure. The patch antenna satisfied these requirements.

These characteristics that make the patch antenna suitable in aircraft and missiles also make it suitable in personal communication devices. For example, the patch antenna can be built near the top surface of a personal communication device such as a portable phone or on a surface of a vehicle carrying a personal communication device. This means that it can be manufactured with increased automation and decreased manual labor of installation. This decreases costs and increases reliability. Also, unlike the whip antenna, the patch antenna is less susceptible to damage by catching on things. Also, since the patch antenna can be built into the personal communication device's top surface, it will not consume interior space which is needed for advanced features and circuits. Furthermore, the patch antenna radiates an omnidirectional pattern into the half space above a ground plane, which makes it suitable in personal communication devices.

While the patch antenna possesses some characteristics that make it suitable for use in personal communication devices, further improvement in other areas of the patch antenna is still desired in order to make it especially attractive for use in personal communication devices, such as cellular and PCS phones. One such area in which further improvement is desired is the length of the patch antenna. Currently available patch antennas are generally too large for use in personal communication devices. A reduction in the length of the patch antenna would make it increasingly desirable for use in personal communication devices. For example, a reduction in the length of the patch antenna would make the personal communication device more compact and aesthetic.

The present invention provides a solution to this problem. The present invention achieves a reduction in the length of a patch antenna while retaining other characteristics that are desirable for use in personal communication devices.

The present invention is directed to a folded quarter-wave patch antenna. According to the present invention, the folded quarter-wave patch antenna includes a folded conductor plate having first and second arms. The folded conductor plate can assume a U-shape, V-shape or any other shapes or forms that can be used to link two arms together in a single structure.

The first and second arms are spaced apart by a predetermined distance. The length of the first arm is approximately $\lambda_0/8$ and the length of the second arm is also approximately $\lambda_0/8$. The length of the conductor plate which is formed by the combination of the first and second arms is approximately $\lambda_0/4$.

A ground plane is separated from the conductor plate by a dielectric substrate. A signal unit may be coupled to the first arm. The signal unit provides a signal of a selected frequency band to the first arm.

2. Example Environment

Before describing the invention in detail, it is useful to describe an example environment in which the invention can be implemented. In a broad sense, the invention can be implemented in any personal communication device. One such environment is a portable telephone, such as that used for cellular, PCS or other commercial service.

FIG. 1 illustrates a portable phone 100. Specifically, FIG. 1 includes a patch antenna 104, a speaker 108, a microphone 112, a display 116, and a keyboard 120.

Antenna 104 is built into the top surface of portable phone 100. Since antenna 104 has a very low profile, it is not subject to damage by catching on things. Also, unlike a retractable whip antenna, antenna 104 does not consume interior space which is needed for advanced features and circuits.

The present invention is described in terms of this example environment. Description in these terms is provided for convenience only. It is not intended that the invention be limited to application in this example environment. In fact, after reading the following description, it will become apparent to a person skilled in the relevant art how to implement the invention in alternative environments.

Figure 2:
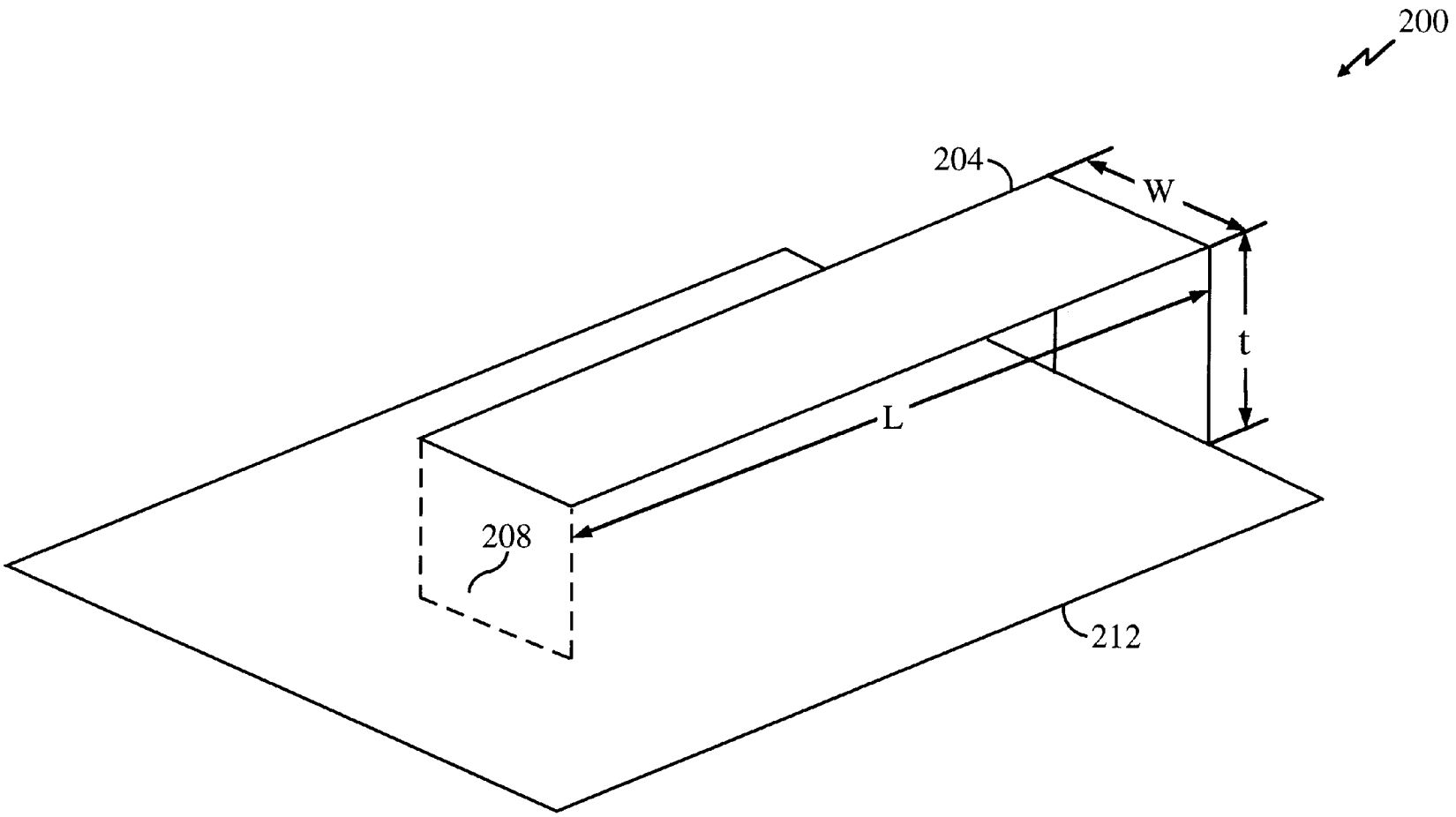
FIG. 2 illustrates a conventional quarter-wave patch antenna.

FIG. 2 illustrates a conventional quarter-wave patch antenna 200. Antenna 200 includes a conductor plate 204, a dielectric substrate 208 and a ground plane 212.

At the cellular frequency band (824–894 MHz), the length of the quarter-wave patch antenna is approximately 3.5 inches, and at the PCS frequency band (1.85–1.99 GHz), the length is approximately 1.5 inches. The conductor plate is separated from a ground plane by a dielectric substrate. The dielectric substrate may be air, glass, or any other dielectric substrate.

The length l of antenna 200 determines its resonant frequency. As a general rule, quarter-wave patch antenna 200 having a length l resonates at a frequency of $c/_{(4l)}$, where c is the speed of light. Thus, the resonant frequency of quarter-wave patch antenna 200 can be selected by selecting l. At or near the resonant frequency, quarter-wave patch antenna 200 radiates most effectively. Consequently, quarter-wave patch antenna 200 is designed to operate at or near the resonant frequency. For example, at the cellular frequency band (824–894 MHz), the wavelength $\lambda$ of the signal is approximately 14 inches. Thus, the length of antenna 200 is approximately 3.5 inches.

The height of antenna 200 is determined mainly by the thickness t of dielectric substrate 208 and to a lesser degree by the thickness of conductor plate 204 and the thickness of ground plane 212. If t is too large, the overall size of antenna 200 becomes too large, which makes antenna 200 undesirable for personal communication devices. Also, if t is too large, surface wave modes are exited which degrades the performance of antenna 200. If, on the other hand, t is too small, i.e., conductor plate 204 is too close to ground plane 212, surface current induced in ground plane 212 tends to be too strong which causes high ohmic loss that degrades the efficiency of antenna 200. In practice, the thickness t of dielectric medium 208 is held at less than or equal to one tenth of the guided wavelength, or $\lambda_g/10$, where $\lambda_g=\lambda_0/\epsilon_{eff}$, $\lambda_0$ is the wavelength in air and $\epsilon_{eff}$ is the dielectric constant in dielectric substrate 208. The guided wavelength is defined as the wavelength in the dielectric, a term which is well-known in the art.

The width w of antenna 200 must be less than a wavelength so that higher order modes will not be exited. Moreover, in order to make the antenna suitable in a personal communication device, the width is kept relatively small.

Ground plane 212 is typically made of a conductive material such as aluminum, copper or gold. Other conductive materials may also be used. Ground plane 212 is separated from conductor plate 204 by dielectric substrate 208 and is approximately parallel to conductor plate 204. One end of conductor plate 204 is electrically connected to ground plane 212.

A probe may be electrically connected to conductor plate 204. The probe, which may be a coaxial cable, passes through ground plane 212 and meets conductor plate 204 near an end. The probe couples a signal unit to conductor plate 204. The signal unit may be coupled to conductor plate 204 by other means such as a micro-strip or a transmission line. The signal unit provides a signal of a selected frequency band, such as, for example, 824–894 MHz, to conductor plate 204, which creates a surface current in conductor plate 204. The density of the surface current is high near the region of conductor plate 204 where the probe meets conductor plate 204 and decreases gradually along the length of the conductor plate 204 in the direction away from the point where the probe meets conductor plate 204. In fact, the surface current is concentrated in the first half of conductor plate 204 and is negligible in the second half.

3. The Present Invention

Figure 3:
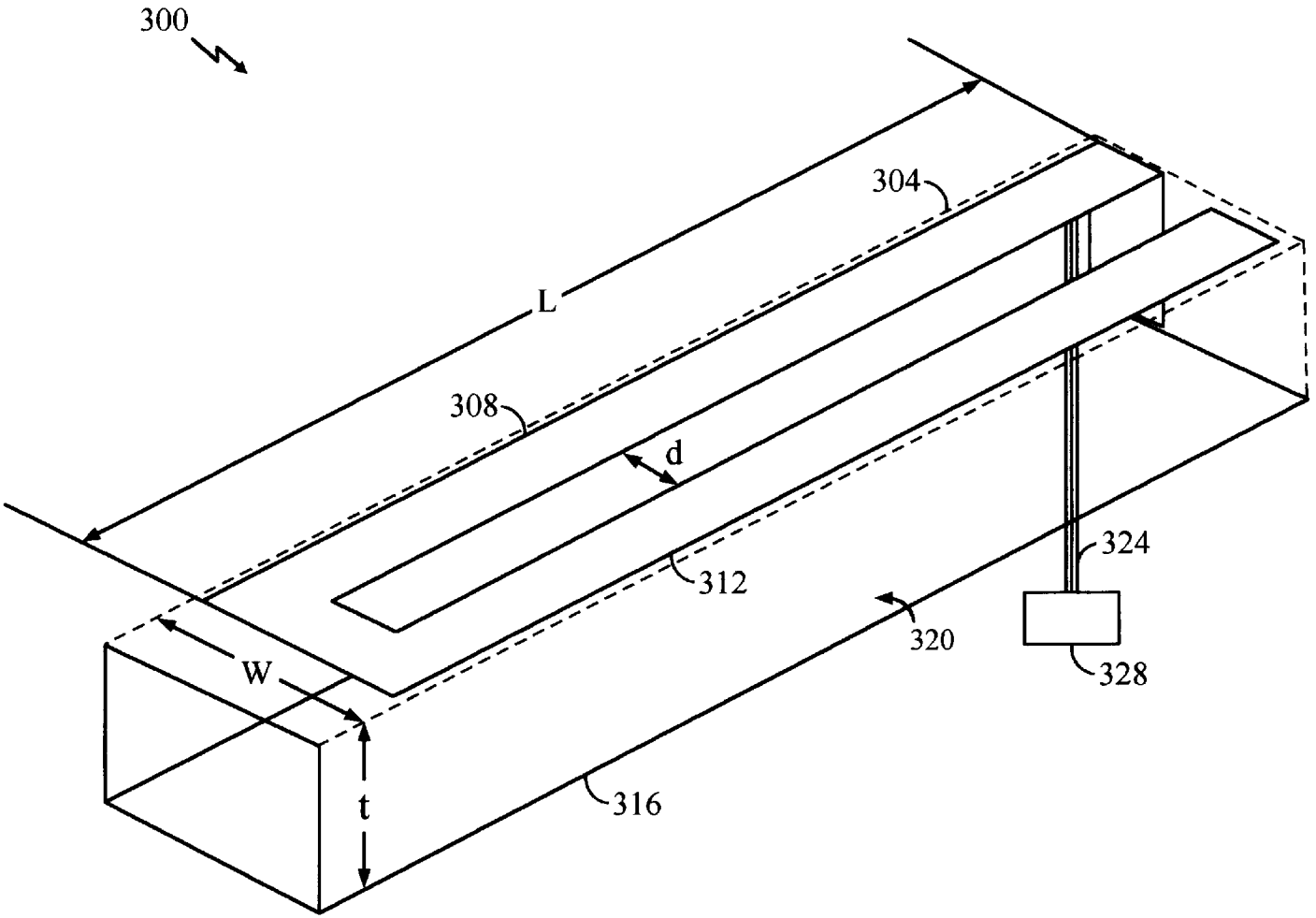
FIG. 3 illustrates a folded quarter-wave patch antenna in accordance with one embodiment of the present invention.

As discussed earlier, a further reduction in size of antenna 200 would make it more desirable in a personal communication device such as a PCS phone or a cellular phone. The present invention achieves a reduction in the size of antenna 200 while retaining the characteristics that are essential in personal communication devices. The present invention will now be described with reference to FIG. 3. FIG. 3 illustrates a folded quarter-wave patch antenna 300 in accordance with the present invention. Specifically, FIG. 3 includes a conductor plate 304 having first and second arms 308 and 312, respectively, a ground plane 316, a dielectric substrate 320, a probe 324 and a signal unit 328.

Note that signal unit 328 is used herein to refer to the functionality provided by a signal source and/or a signal receiver. Whether signal unit 328 provides one or both of these functionalities depends upon how antenna 300 is configured to operate. Antenna 300 could, for example, be configured to operate solely as a transmitter, in which case signal unit 328 operates as a signal source. Alternatively, signal unit 328 operates as a signal receiver when antenna 300 is configured to operate solely as a receiver. Signal unit provides both functionalities (e.g., a transceiver) when antenna 300 is configured to operate as both a transmitter and receiver. Those skilled in the art will recognize the various ways in which the functionality of generating and/or receiving signals might be implemented.

As shown in FIG. 3, conductor plate 304 is folded into a U-shaped pattern creating first and second arms 308 and 312. The length of each arm is approximately $\lambda/8$. The combined length of first and second arms is approximately $\lambda/4$. First and second arms 308 and 312 are separated by an air gap of a distance d.

In one embodiment of the present invention, air is selected as dielectric substrate 320. Air has a dielectric constant of approximately 1 and it produces a negligible dielectric loss. Because the personal communication devices are typically powered by batteries that have limited energy storage capability, it is important to reduce dielectric loss in antenna 300. Thus, air is selected as the preferred dielectric medium because it produces a negligible dielectric loss.

As before, the height of antenna 300 is determined mainly by the thickness t of dielectric substrate 320 and to a lesser degree by the thickness of conductor plate 304 and the thickness of ground plane 316. If t is too small, conductor plate 304 is too close to ground plane 316. As a result, a surface current induced in ground plane 316 tends to be very strong which results in high ohmic loss in ground plane 316. Consequently, the efficiency of antenna 300 is degraded. If on the other hand, t is too large, surface wave modes are excited which degrades the antenna's performance.

Ground plane 316 is made of a conductive material such as, for example, aluminum, copper, silver or gold. Ground plane 316 is separated from conductor plate 304 by dielectric substrate 320 and is approximately parallel to conductor plate 304. One end of conductor plate 304 is electrically connected to ground plane 316.

Probe 324 is electrically connected to first arm 308. Probe 324, which may be a two element conductor, such as a coaxial cable, passes through ground plane 316 and meets first arm 308 near an end. Probe 324 couples signal unit 328 to first arm 308. Signal unit 328, however, may also be coupled to conductor plate 304 by other means such as a microstrip or a transmission line. Signal unit 328 provides antenna 300 with a signal having a selected frequency band. For example, the selected frequency band may be the cellular frequency band (824–894 MHz) or the PCS frequency band (1.85–1.99 GHz). Other frequencies may also be provided, such as, for example, a 1.6 GHz signal.

The present invention reduces the overall dimension (i.e., foot-print) of conventional quarter-wave patch antenna 200 by folding it in half into a U-shaped antenna. By folding quarter-wave patch antenna 200 in half, the length of the antenna assembly structure is reduced from approximately $\lambda/4$ to approximately $\lambda/8$, which makes it smaller in size.

In the past, when antenna designers contemplated ways to reduce the length of an antenna, they came to a conclusion that if a quarter-wave patch antenna is folded into a structure having first and second arms, it would result in the cancellation of its far field. Their conclusion was based on an erroneous assumption that the current in the first arm is equal in magnitude but opposite in direction to the current in the second arm. This, they believed would result in a cancellation of the antenna's far field.

However, Applicant has discovered that, in antenna 300, the surface current is much stronger in the first half of conductor plate 304 than it is in the second half. Since, the surface current is concentrated only in the first half of conductor plate 304, antenna 300 can be folded in half into the U-shape having first and second arms 308 and 312 without a cancellation of its far field.

Signal unit 328 provides first arm 308 a signal of a selected frequency band, such as, for example, the PCS frequency band (1.85–1.99 GHz) or the cellular frequency band (824–894 MHz), which creates a surface current in first arm 308. The surface current is concentrated in first arm 308 and is negligible in second arm 312. Thus, despite the fact that conventional quarter-wave patch antenna 200 has been folded in half, the far field is not canceled because of the negligible surface current in second arm 312. Thus, the present invention takes advantage of the fact that the surface current is concentrated only in the first half of conventional quarter-wave patch antenna 200 and folds antenna 300 in half to obtain an approximately 50% reduction in overall length.

Figure 4:
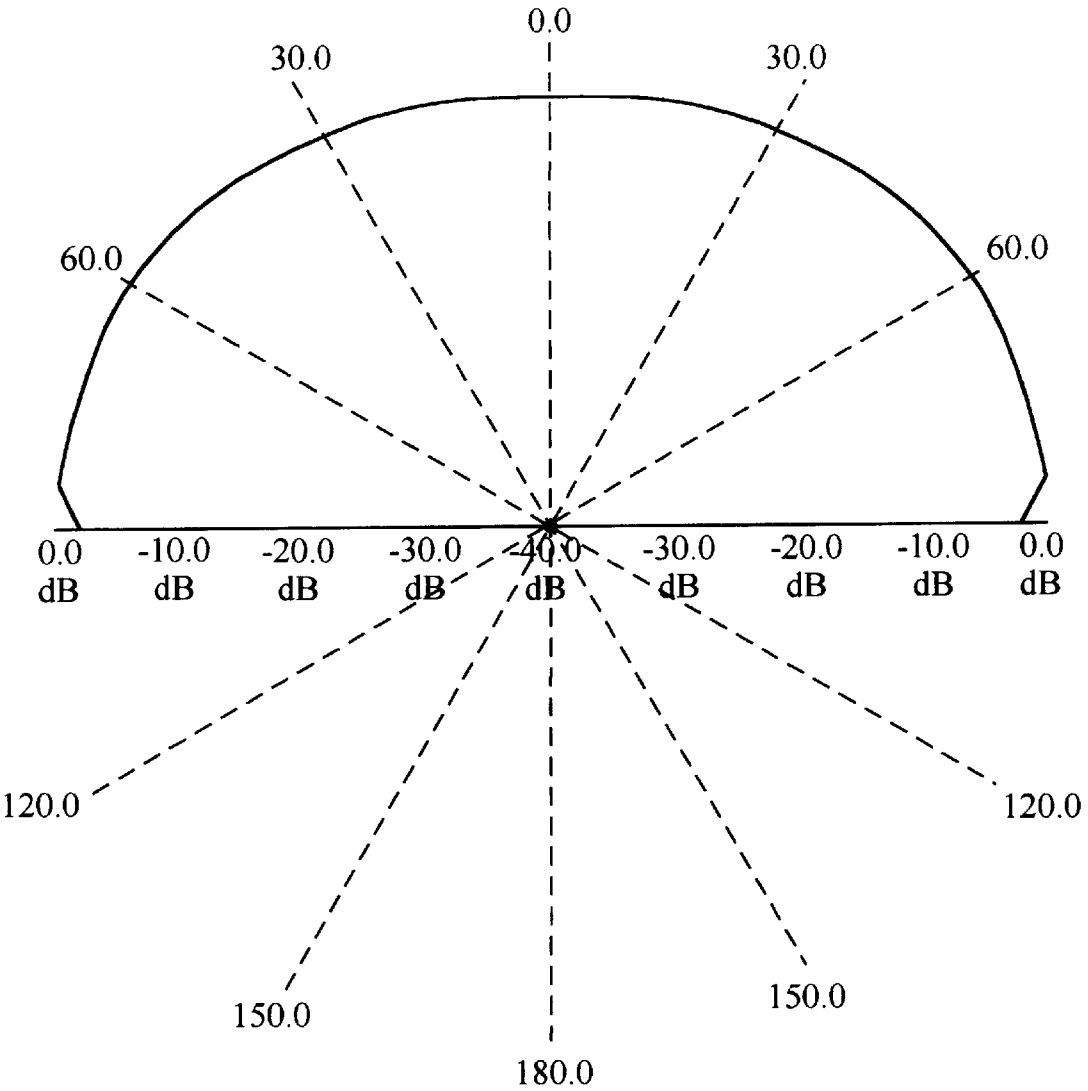
FIG. 4 illustrates a computer simulated radiation pattern in polar coordinates for the folded quarter-wave patch antenna of FIG. 3.

FIG. 4 illustrates a computer simulated radiation pattern in polar coordinates for the embodiment of folded quarter-wave patch antenna 300 illustrated in FIG. 3. The results of the simulation are provided as an example only, not as a limitation of the application of the present invention. In this example, the operating frequency of antenna 300 is approximately 920 MHz. The electric field intensity is maximum at $\phi$=85 degrees. The directivity is 4.35045 dB. The efficiency of antenna 300 is 96.7073%.

Figure 5:
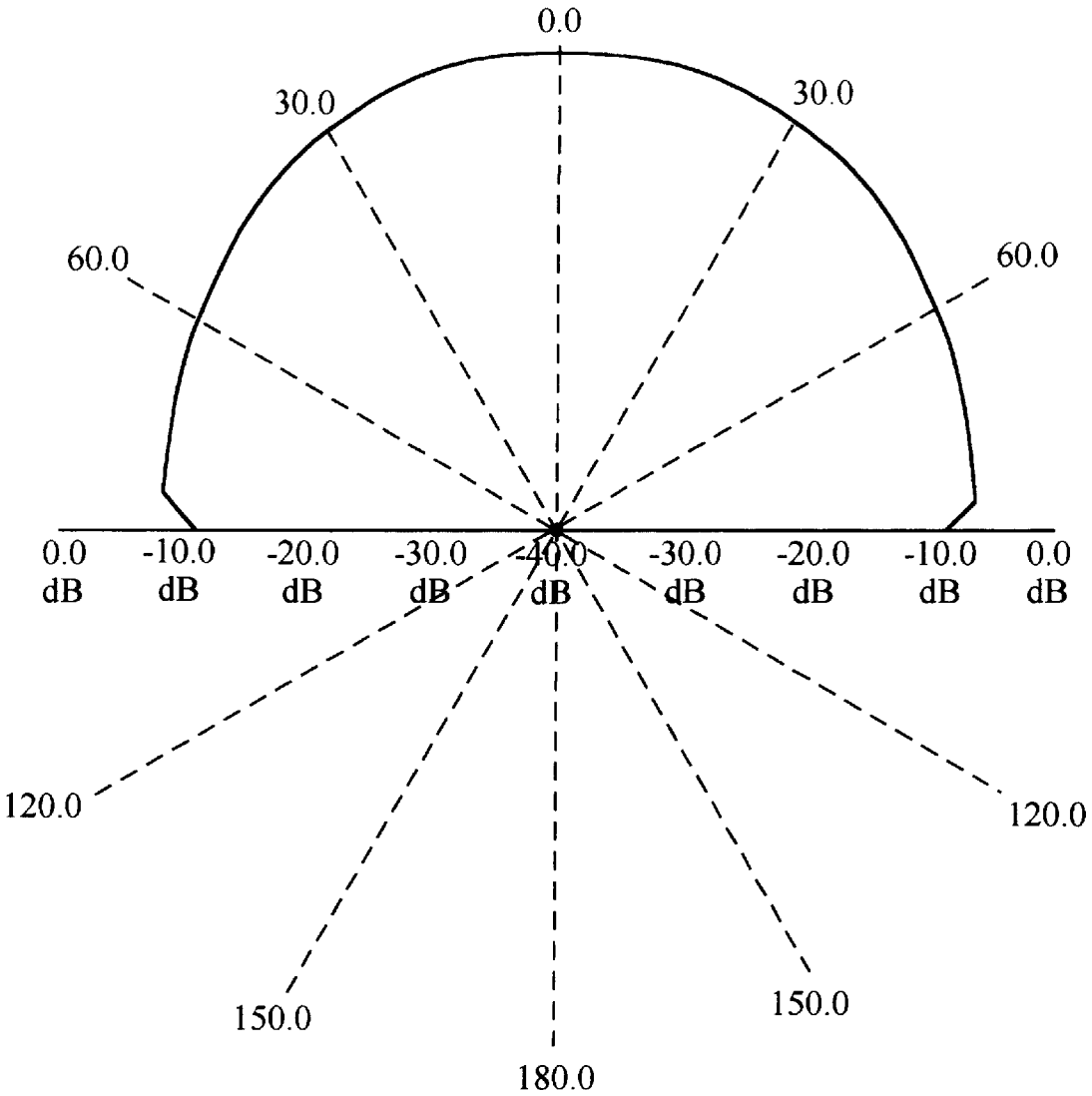
FIG. 5 depicts the radiation pattern of the antenna.

FIG. 5 depicts a computer simulated radiation pattern of antenna 300. In this example, antenna 300 is operating at approximately 2.2 GHz. The intensity of the electric field is maximum at 170 degrees. The directivity is 6.3299 dB. The efficiency of antenna 300 is 98.2944%.

In many applications, transmission and reception occur at two different frequency bands. Also, some applications require that devices operate at dual frequency bands. For example, a device may operate as both a PCS phone and cellular phone. Such a device is required to transmit and receive signal having a frequency band of 824–894 MHz (for the cellular phone) and also transmit and receive signal having a frequency band of 1.85–1.99 GHz (for the PCS phone). In such applications, dual frequency band antennas are desirable. Dual frequency band antennas allow the flexibility of using a communication device for multiple applications.

In the past, dual frequency band antennas were often constructed by stacking two single band antennas together. The present invention provides a simple alternative to that practice. The present invention allows folded quarter-wave patch antenna 300 to be operated as a dual frequency band antenna.

In dual frequency band operation, signal unit 328 provides antenna 300 with two signals: a first signal of a first frequency band; and a second signal of a second frequency band. The first frequency band may be, for example, the cellular frequency band (824–894 MHz) and the second frequency band may be, for example, the PCS frequency band (1.85–1.99 GHz).

The operation of antenna 300 at the cellular band (824–894 MHz) has been described earlier. When antenna 300 is fed with the PCS band (1.85–1.99 GHz), the surface current created by the PCS band is essentially concentrated in second arm 312 instead of first arm 308 because the PCS band (1.85–1.99 GHz) is a higher order mode for quarter-wave patch antenna 300. Thus, in dual frequency band operation, the cellular frequency band is concentrated in first arm 308 and the PCS frequency band is concentrated in second arm 312. First arm 308 resonates at the first frequency band and second arm 312 resonates at the second frequency band.

Figure 6:
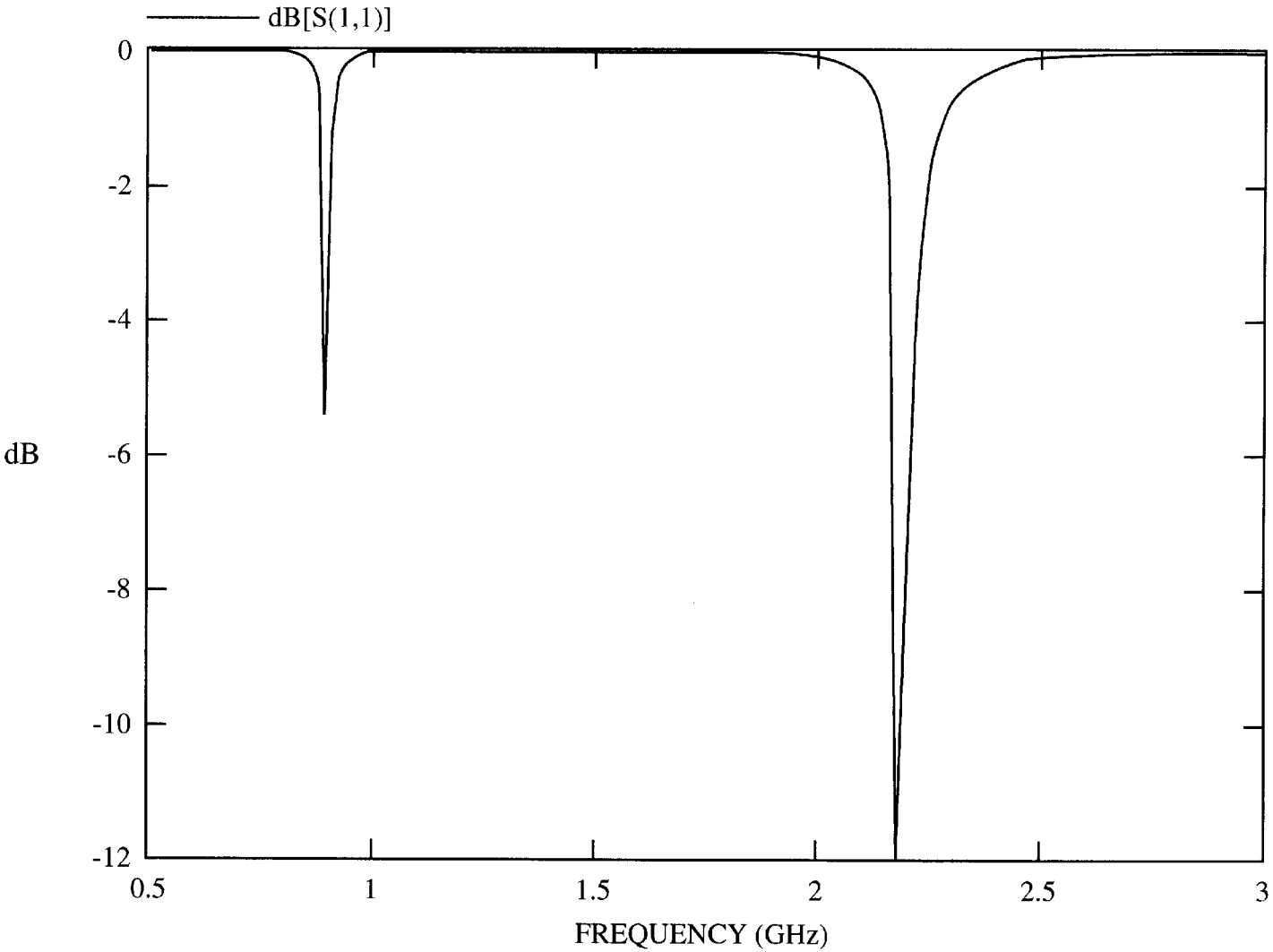
FIG. 6 illustrates a computer simulated frequency response of a dual frequency band.

FIG. 6 depicts a computer simulated frequency response of antenna 300 operating as a dual frequency band antenna. In this example, antenna 300 operates at approximately 920 MHz and 2.2 GHz.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What I claim as my invention is:

1. A folded quarter-wave patch antenna, comprising:

a folded conductor plate formed from a single conductor and having a first end and a second end, said conductor plate forming first and second arms in parallel with each other, wherein a signal unit is coupled to said first arm, said signal unit feeding said antenna a first signal of a first frequency band such that said first signal creates surface current on said conductor plate, said surface current being substantially greater in magnitude in said first arm then in said second arm; and a ground plane separated from said conductor plate by a dielectric substrate, said ground plane electrically connected to said conductor plate first end, said conductor plate second end electrically isolated from said ground plane.

2. The folded quarter-wave patch antenna according to claim 1, wherein said ground plane is substantially parallel to said conductor plate.

3. The folded quarter-wave patch antenna according to claim 1, wherein said ground plane is electrically connected to said first arm at one end.

4. The folded quarter-wave patch antenna according to claim 1, wherein the length of said conductor plate is approximately $\lambda/4$, said $\lambda$ being a wavelength of said first signal.

5. The folded quarter-wave patch antenna according to claim 1 wherein the length of said first arm is approximately $\lambda/8$.

6. The folded quarter-wave patch antenna according to claim 1 wherein the length of said second arm is approximately $\lambda/8$.

7. The folded quarter-wave patch antenna according to claim 1, further comprising a signal unit coupled to said first arm, said signal unit feeding said antenna a first signal of a first frequency band, said signal unit feeding said antenna a second signal of a second frequency band.

8. The folded quarter-wave patch antenna according to claim 1, wherein said first arm resonates at said first frequency band, and said second arm resonates at said second frequency band, wherein said folded patch antenna acts as a dual frequency band antenna.

* * * * *